United States Patent [19]

Howard et al.

[11] 4,332,324

[45] Jun. 1, 1982

[54] MANUFACTURE OF ROLLS OF FIBROUS WEB MATERIAL

[75] Inventors: Thomas B. Howard; Gerald H. Puissant, both of Green Bay, Wis.

[73] Assignee: American Can Company, Greenwich, Conn.

[21] Appl. No.: 119,162

[22] Filed: Feb. 6, 1980

[51] Int. Cl.[3] ..... B65D 85/67; B65D 85/671

[52] U.S. Cl. ..... 206/389; 206/53; 242/1

[58] Field of Search ..... 206/389, 53; 229/45; 242/1

[56] References Cited

U.S. PATENT DOCUMENTS

| | | | |
|---|---|---|---|
| 3,326,448 | 6/1967 | Neal | 229/45 |
| 3,366,529 | 1/1968 | Olson . | |
| 3,393,105 | 7/1968 | Tellier, Jr. | 156/187 |
| 3,448,502 | 6/1969 | Tesch | 28/72.2 |
| 3,451,885 | 6/1969 | Klein | 28/72.2 |
| 4,177,897 | 12/1979 | Cole | 206/389 |

*Primary Examiner*—William T. Dixson, Jr.

*Attorney, Agent, or Firm*—Robert P. Auber; George P. Ziehmer; Harry W. Hargis, III

[57] ABSTRACT

The tail of a roll of fibrous web material is secured to underlying layers through penetration of the layers by a row of needles extending tangentially of the roll and in the same direction that the tail extends or is presented. Penetration is to a depth of about 6 layers, and is accompanied by punching out a very small tab of each layer and pushing it into the opening of the successive, underlying layer thereby to lock the tail in place. Pulling the tail to unwind layers from the roll pulls the tabs from succeeding layers in the direction of unwinding, without tearing the outer layer.

2 Claims, 7 Drawing Figures

MANUFACTURE OF ROLLS OF FIBROUS WEB MATERIAL

BACKGROUND OF THE INVENTION

This invention relates to the manufacture of rolls of fibrous web material, and especially to improvements in releasably securing the tail or terminal portion of the outer layer of the web material to successive underlying layers.

Improvement resides in provision of securement means that requires no adhesive, and is readily releasable without tearing the layers upon unwinding the roll.

The following U.S. Pats. are representative of the prior art, and are believed material to the examination of this application.

U.S. Pat. No. 3,393,105 discloses a method and apparatus for adhesively securing the tail of a product to the underlying convolution thereof.

U.S. Pat. No. 3,448,502 discloses a method for producing textile goods containing an upper layer and a base layer by means of needling.

U.S. Pat. No. 3,451,885 discloses a composite web formed by needling a plurality of webs.

U.S. Pat. No. 3,366,529 discloses a fibrous fleece needled to a base film of thermoplastic material.

Further to the prior art of which applicant is aware, it is known to secure the tail of a roll of fibrous web material by tangentially penetrating wound layers of a roll with laterally spaced parallel needles to a depth of about 3 to about 5 layers, in a direction opposite to the direction of presentation of the tail. Securement of this type has proven satisfactory for rolls of web material that are relatively loosely wound and characterized by high bulk. For rolls of this type, needle securement is readily released upon initially unwinding the roll, without tearing of the secured layers. When the same mode of securement was resorted to for lower bulk rolls of more tightly wound web material, the needled securements were found not readily releasable upon unwinding of the tail, often resulting in stringing or tearing of the layers.

We have made the important discovery that by repositioning the needles tangentially to penetrate the layers in the same direction of presentation of the tail achieves a needled securement that overcomes the problem of stringing.

It is accordingly an objective of our invention to provide improved tail securement of a roll of fibrous web material.

It is a further objective to provide an improved tail securement for a roll of web material that is readily releasable without damage to the material.

It is another objective to provide improved tail securement for a roll of relatively tightly wound fibrous web material.

SUMMARY OF THE INVENTION

In achievement of the foregoing as well as other general objectives, the invention contemplates roll tail securement wherein a plurality of needles are caused substantially tangentially to penetrate a roll of fibrous web material in the direction of presentation of the tail, thereby to punch out very small tabs in each of several layers and push them into openings of successively underlying layers. Advantageously, the tabs are presented in the direction of presentation of the tail, so that pulling the tail away from the roll to unwind the layers of web material releases the securement by pulling the tabs out of the small openings, thereby avoiding stringing of the layers.

The manner in which the foregoing as well as other objectives and advantages of the invention may best be achieved will be more fully understood from the following description taken in light of the accompanying drawing.

DESCRIPTION OF THE PREFERRED EMBODIMENTS AND PRACTICE OF THE INVENTION

Rolls of fibrous web material to which the invention is especially, but not exclusively, directed comprise elongate, tightly wound rolls or logs of toilet tissue. The rolls of tissue may comprise, for example, 4.5 inch-diameter rolls of single ply tissue of about 0.0029 caliper, 12½ lbs./ream basis weight, and perforated to form about 1000 sheets per roll. Alternatively, a 4.5 inch-diameter roll may comprise 10 lbs./ream, two-ply tissue perforated to form about 500 sheets. The logs are cut into individual rolls, and then enclosed in wrappers. Prior to cutting and to facilitate wrapping after cutting, the tail of the roll is secured to underlying layers of tissue.

With reference to FIGS. 1 to 5, it is seen that the present invention contemplates improvements in the securement of the tail 11 of a relatively tightly wound roll of toilet tissue designated generally by the numeral 10. For convenience of illustration, the invention will be described in terms of a short roll 10 cut from a log of single ply tissue, it being understood that securement of tail 11 is performed on the considerably longer log.

Figure 4:
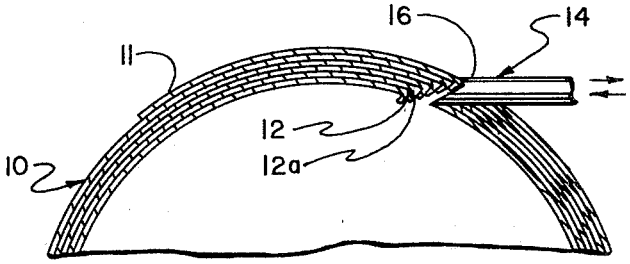
FIG. 4 is section similar to FIG. 2, illustrating apparatus and method aspects of the invention.

In the art of tail securing or sealing, and as is disclosed in the hereinabove identified U.S. Pat. No. 3,393,105, it is a practice to convey unsealed logs of toilet tissue from a conventional rewinding apparatus to a tail sealing station, into which a log is fed laterally of its longitudinal axis. The station includes longitudinally extending drive rollers that receive and support the log while being selectively operative to rotate the log to a suitable rest position, as seen in FIG. 4, in which the tail has been indexed to a predetermined position for actuation of the securement device to be described in detail in what follows. Indexing of the tail is afforded by photoelectrically locating the tail as air jets blow it away from the surface of the log while it is being continuously rotated, and upon such location, rotating the log a sufficient predetermined distance to index the tail to the position shown. Suitable clamping means is then provided to hold the log in position for tail securement, following which the log is released and removed laterally for subsequent sawing into and wrapping of individual rolls.

Figure 1:
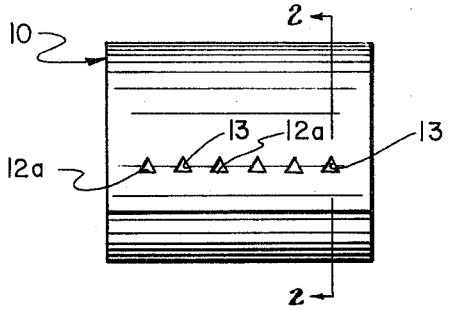
FIG. 1 is an elevational showing of a roll of fibrous material embodying an article aspect of the invention.
Figure 2:
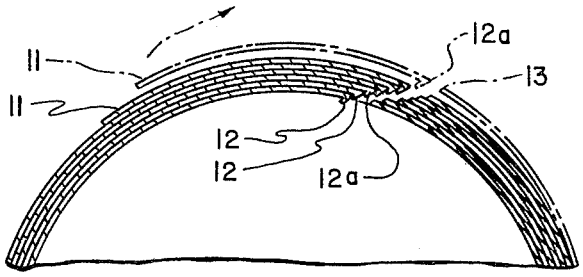
FIG. 2 is an enlarged fragmentary section taken along the line 2—2 in FIG. 1, looking in the direction of arrows applied thereto, rotated through about 90° for convenience of illustration, and with a part shown in phantom to show partial release of the tail.
Figure 3:
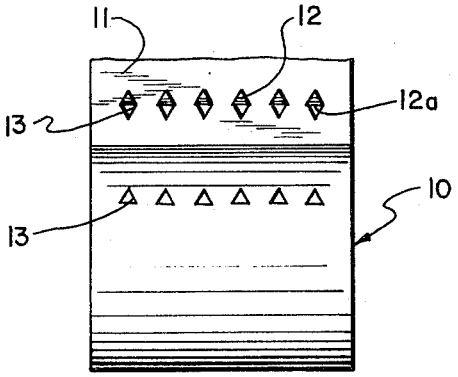
FIG. 3 is an elevational showing of the roll, showing release of the tail.

By way of example, and in especial accordance with the invention, roll 10 as seen in FIGS. 1 and 2 is a relatively tightly-wound, single-layer toilet tissue, wherein its tail 11 is held in place or secured by generally triangularly shaped tabs 12 disposed in spaced linear array across the roll, cut from the layer to form a corresponding row or linear array of triangular holes 13, and folded about base portions 12*a* thereof inwardly of the holes 13 to a depth of several layers, for example up to about six layers. As is seen in FIG. 2, the tabs 12 further are presented generally toward the free end of tail 11, and frictionally engage portions of the layers that define holes 13, thereby to secure the tail. To unwind the roll, and with reference to the broken line showing of FIG. 2, and also to FIG. 3, the user grasps and pulls tail 11 in an unwinding motion, wherein the disposition of tabs 12 is such that (ie. they are presented toward the end of the tail) they pull substantially straight out of the holes 13, without stringing or tearing of the layer.

Figure 5:
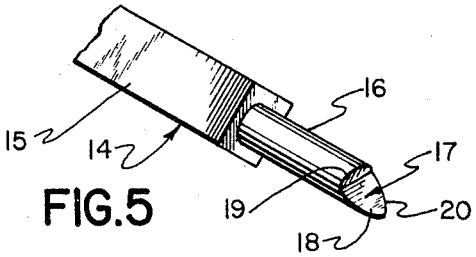
FIG. 5 is a perspective showing, on an enlarged scale, of part of the apparatus seen in FIG. 4.

In achievement of the improved tail securement structure, and with reference to FIGS. 4 and 5, apparatus of known construction (not shown) holds a log from which roll 10 is cut so that its tail is presented in a predetermined orientation as shown in FIG. 4. In especial accordance with the invention, the apparatus further includes a linear array or row of laterally spaced, parallel securement needles corresponding to the array of holes 13, only one needle of which is shown at 14 supported by suitable means (not shown) operative to move the needles toward and away from roll 10, in accordance with directional arrows applied thereto. Each needle 14 includes a rectangular base portion 15 and a roll layer penetrating portion 16 of cylindrical shape, about 0.062 inch diameter, about ¼ inch long, and having a generally wedge-shaped tip 17 comprising a partially elliptical face portion 18 having its major axis extending at about a 30° angle to the axis of the needle and having its minor axis pependicular to the axis of the needle. Face portion 18 termaintes toward its upper end at a partially circular face portion 19 substantially perpendicular to face portion 18, and forms a cutting edge 20 along its line of intersection with the cylindrical surface. As is illustrated in FIG. 4, each needle 14 further is mounted for substantially tangential extent as respects the roll 10, so that the minor axis of its face portion 18 is substantially parallel to the axis of the roll.

In operation, the needles are movable by their support means simultaneously toward the roll in the direction of presentation of tail 11, a predetermined distance to cause each needle to penetrate the roll for a distance of several layers, for example up to about six layers as seen in FIG. 4, wherein the needle 14 is shown in partially retracted position for convenience of illustration. As each layer is penetrated, a generally triangular tab 12 is cut by a needle 14 from the layer and, with the cooperative urging of face portions 18 and 19, folded about the connected base portion 12*a* of each tab inwardly of the layers through underlying holes, into the described frictional, tail securing engagement. Following roll securements, the needles are retracted, the roll is removed, a new roll is positioned and the securement process repeated.

Figure 6:
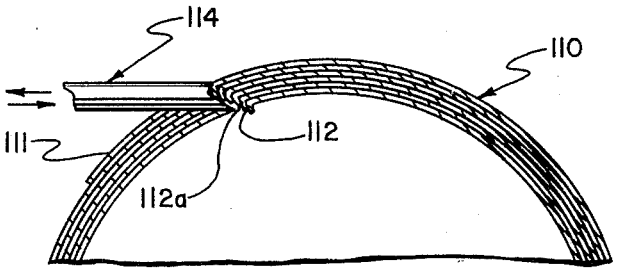
PRIOR ART FIG.6
FIGS. 6 and 7 are showings of prior art embodiments and practice over which the present invention is an improvement.
Figure 7:
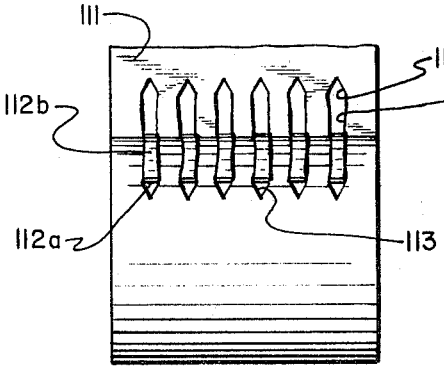
PRIOR ART FIG. 7

Advantages achieved by the present invention will be more fully appreciated from consideration of the prior art showings of FIGS. 6 and 7, wherein needles 114 similar to that described in connection with FIGS. 4 and 5 are mounted for movements on the same side as the tail 111 of a roll 110, in accordance with directional arrows in FIG. 6. Movements are toward and away from roll 110 in such a manner that each needle 114 penetrates the layers to cut and force tabs 112 inwardly of holes 113 (FIG. 7) formed thereby, and each into frictional engagement with underlying layers. Formation of a tab 112 in this manner is characterized by disposition of its base fold line 112*a* on the side of a hole away from the free end of tail 111 so that the tabs are presented away from the end or the direction of presentation of, of the tail. By such disposition of the fold lines, taken with the presentation of tabs 112 away from the direction of presentation of tail 111, pulling of the tail to unwind the roll, while releasing satisfactorily in the case of higher bulk, loosely wound rolls of about 4.9 inch diameter having about 400 sheets, often in the case of the tightly wound roll is disadvantageously accompanied by retention of a tab to the extent that stringing of the tissue occurs, as shown at 112*b* in FIG. 7 wherein tabs 112 have torn out of the layer to elongate the holes 113, as seen at 113*a*.

From the foregoing description it will be appreciated that the invention affords improved means for achieving effective tail sealing or securement of tightly wound rolls of toilet tissue, without need for adhesive. While preferred practice and embodiments of the invention have been disclosed, it wil be understood that it is susceptible of such modifications as may fall within the scope of the appended claims.

We claim:

1. In a roll of fibrous web material, means securing its tail comprising a series of generally triangular tabs in linear array extending across said web, and cut from layers of said material to form aligned generally triangular openings in successive underlying layers, said tabs folded into, and frictionally retained within, said aligned openings along sides thereof closer to said tail and substantially parallel to the axis of said roll, said tabs presented in the direction of presentation of said tail.

2. A method for securing the tail of a roll of fibrous web material to underlying layers thereof, comprising the steps of: providing a plurality of laterally spaced, unidirectionally extending needles; and inserting said needles into several layers of said roll, tangentially thereof in the direction of presentation of said tail, to urge the fibers of one layer into an opening produced in the next underlying layer, thereby to secure said tail, wherein each said needle is so shaped and disposed as to cut a tab of material comprising said fibers in producing an opening, and to fold said tab in the direction of presentation of said tail upon urging the fibers of one layer into said opening.

* * * * *